US006935880B1

(12) United States Patent
Su

(10) Patent No.: US 6,935,880 B1
(45) Date of Patent: Aug. 30, 2005

(54) COUPLING FIXTURE FOR INSERTING POWER SUPPLY INPUT SOCKETS

(75) Inventor: Chun-Lung Su, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/855,440

(22) Filed: May 28, 2004

(51) Int. Cl.[7] ..... H01R 4/60
(52) U.S. Cl. ..... 439/218
(58) Field of Search ..... 439/218, 660, 439/217–224, 694, 693, 639

(56) References Cited

U.S. PATENT DOCUMENTS 5,609,414 A * 3/1997 Caluori ..... 362/366
6,459,590 B2 * 10/2002 Malnati ..... 361/752
6,530,793 B2 * 3/2003 Eichhorn et al. ..... 439/218
2004/0124237 A1 * 7/2004 Bros et al. ..... 231/7

* cited by examiner

*Primary Examiner*—J. F. Duverne
(74) *Attorney, Agent, or Firm*—Birch, Stewart, Kolasch & Birch, LLP

(57) ABSTRACT

A coupling fixture for inserting power supply input sockets includes a coupling frame to couple with a power cord latch clip when an inserting power supply input socket is inserted in a power supply. The coupling frame is sandwiched between the receptacle of the power supply input socket and the power supply, and has an opening to receive the body of the power supply input socket and anchor flanges extended from two sides that have respectively an anchor bore to couple with the power cord latch clip thereby to overcome the problems occurred to the conventional power cord coupling fixtures used on the inserting power supply input sockets.

9 Claims, 4 Drawing Sheets

COUPLING FIXTURE FOR INSERTING POWER SUPPLY INPUT SOCKETS

FIELD OF THE INVENTION

The present invention relates to a coupling fixture for inserting power supply input sockets and particularly to a coupling fixture for inserting power supply input sockets that also couples the power cord.

BACKGROUND OF THE INVENTION

Refer to FIG. 1 for a prior art disclosed in R.O.C. patent No. 557096 entitled "Power cord anchoring structure" which aims to prevent the power cord from loosening off from the power supply and avoid operation troubles. It includes a power cord coupling fixture between the power cord and the power supply to improve anchoring and connection of the power cord. The coupling fixture has a holding section to grip the power cord and a retaining section to confine the power cord in the holding section, and a bracing section linking to a connecting section in a bent manner, and a hook section to latch on the power supply.

As shown in FIG. 1, the power supply has extended anchor lugs to latch the coupling fixture. Due to the power supply adopted for the common 1U specification has limited installation space, the power supply input socket has to adopt the insertion type. Such type of power supply cannot spare extra space to form the anchor lugs for this purpose. Moreover, even for other types of power supply, the power cord plugging location also has to be altered to match installation of the air fan, power switch and indication lights. Hence directly forming the anchor lugs on specific locations will affect the compatibility and create many different specifications and result in higher fabrication costs.

SUMMARY OF THE INVENTION

The primary object of the invention is to solve the aforesaid disadvantages. The present invention provides a coupling fixture for inserting power supply input sockets that does not need to form additional anchor lugs on the power supply and is adaptable to the existing inserting power supply input sockets within the limited space. The coupling fixture according to the invention is located between the receptacle of the power input socket and the power supply. It includes an opening to receive the body, two anchor flanges extended from two sides that have anchor bores to couple with a power cord latch clip. Thus it eliminates the problems occurred to the conventional inserting power cord coupling fixtures and does not have to form extra anchor lugs on the power supply and can improve compatibility.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
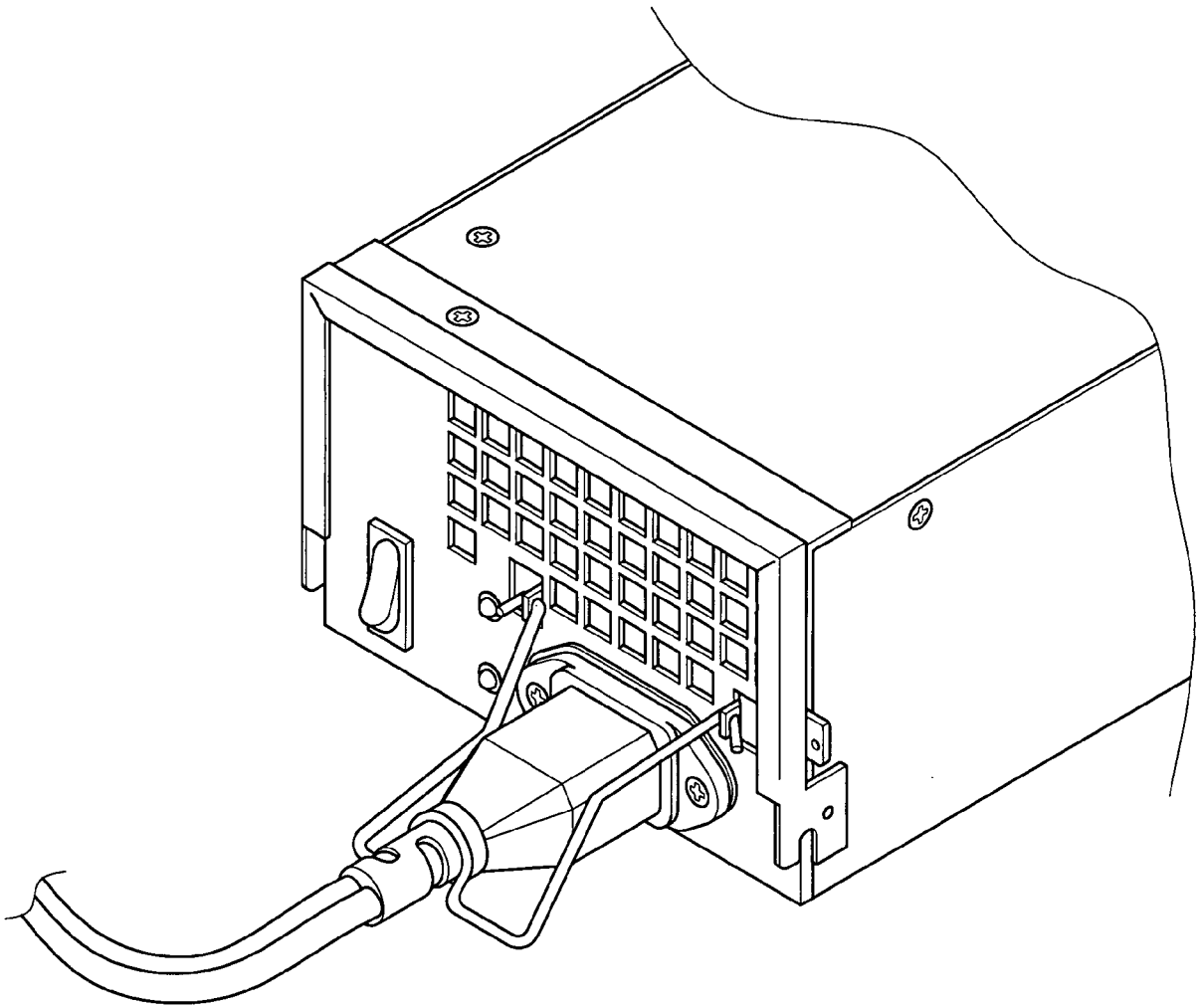
Fig. 1 PRIOR ART
FIG. 1 is a schematic view of a conventional power cord coupling fixture.
Figure 2:
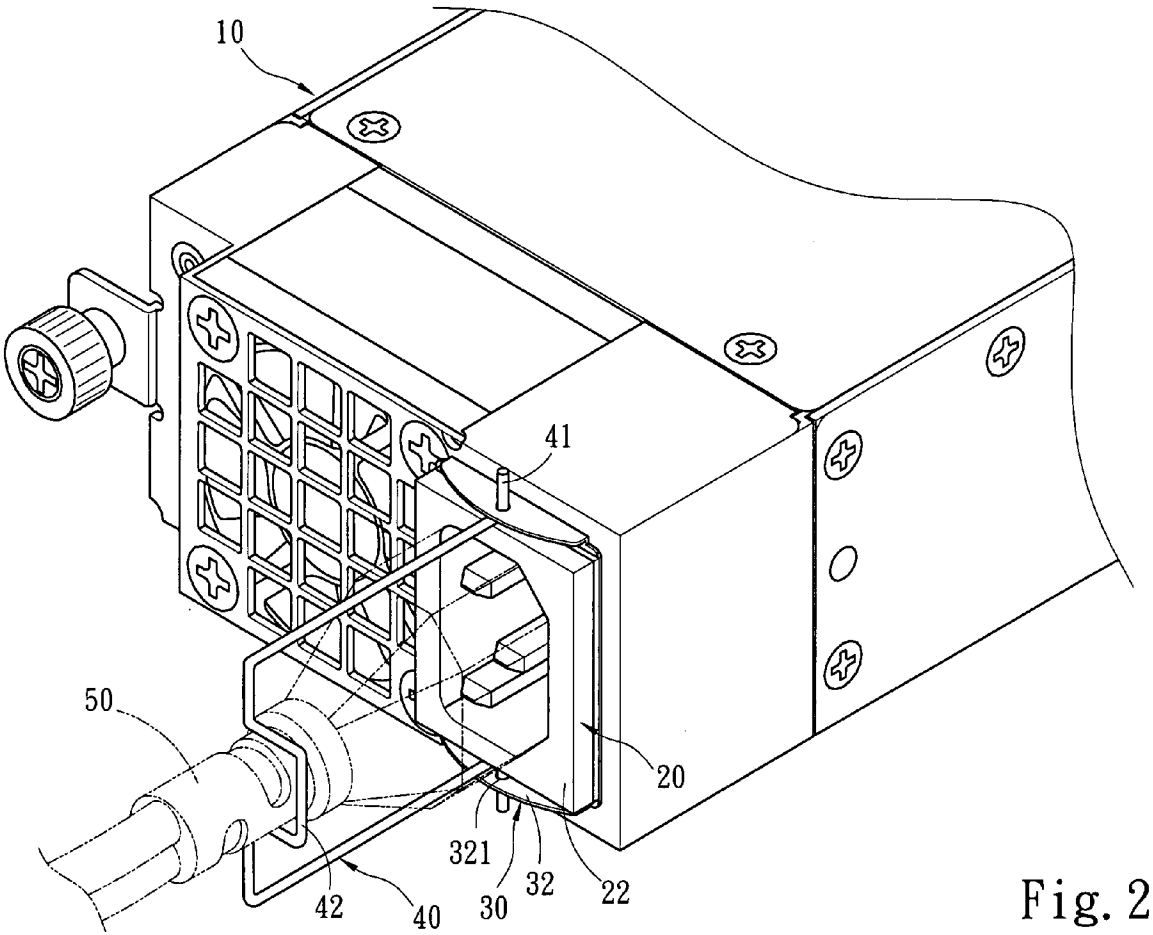
FIG. 2 is a perspective view of the power cord latch clip and the coupling frame of the present invention.
Figure 3:
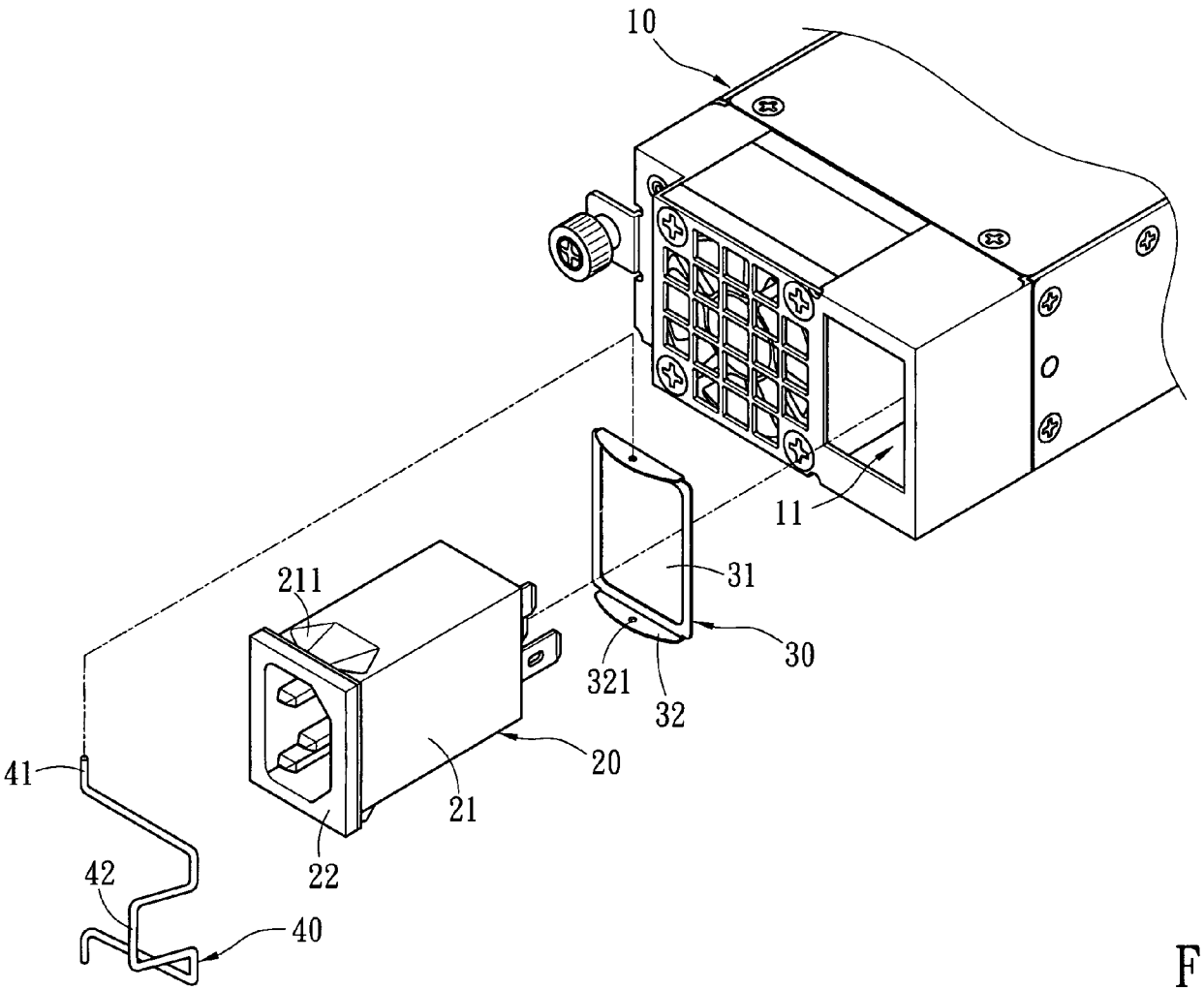
FIG. 3 is an exploded view of the invention.
Figure 4:
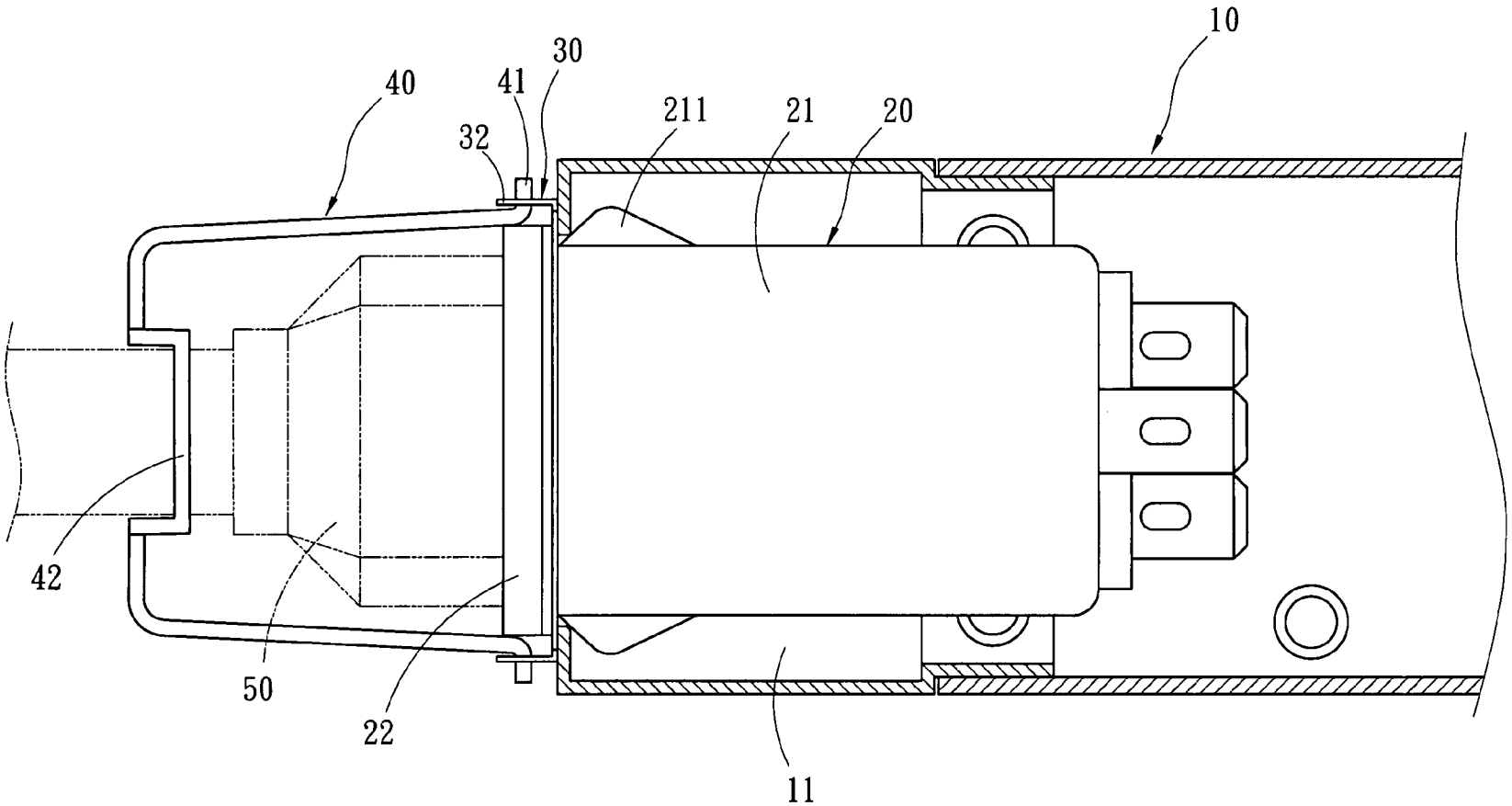
FIG. 4 is a sectional view of the invention.

Please referring to FIGS. 2, 3 and 4, the coupling fixture according the invention is adopted for use on an inserting power supply input socket 20 of a power supply 10. It includes a coupling frame 30 and a power cord latch clip 40. The power supply 10 has a housing section 11 to accommodate the power supply input socket 20. The power supply input socket 20 includes a body 21 to be housed in the housing section 11 and a receptacle 22 exposed outside the housing section 11. The coupling frame 30 is located between the receptacle 22 of the power supply input socket 20 and the power supply 10. It has an opening 31 to receive the body 21 and two anchor flanges 32 extended from two sides with an anchor bore 321 formed respectively thereon.

For assembly, first, couple the coupling frame 30 with the body 21 of the power supply input socket 20 through the opening 31 to be abutting the receptacle 22; insert the power supply input socket 20 into the housing section 11 of the power supply 10; the body 21 has elastic latch blades 211 which are latched on the housing section 11 after the body 21 was fully inserted into the housing section 11 so that the coupling frame 30 is sandwiched and clamped between the receptacle 22 and the power supply 10 to form a secure anchoring. The anchor bores 321 on the two extended anchor flanges 32 may be coupled with hooks 41 formed on two sides of the power cord latch clip 40. When a power cord 50 is inserted into the power supply input socket 20, a holding section 42 formed on the power cord latch clip 40 can grip the power cord 50 securely to achieve a desired anchoring effect.

By means of previous discussion, it is clear that by employing the coupling frame 30 to couple with the power cord latch clip 40, there is no need to form the anchor flanges 32 on the power supply 10 through additional machining. The invention uses the existing space on the power supply input socket 20, and can use the power cord latch clip 40 in a limited available space to securely hold the power cord 50 when adopted on the inserting power input socket 20 on the power supply 10.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A coupling fixture comprising:

a power supply, the power supply having a housing with an socket opening;

a coupling frame, the coupling frame including an opening and two anchor flanges, the two anchor flanges extending from two ends of the opening respectively, each of the two anchor flanges having an anchor bore, a body of a power supply input socket being inserted into the socket opening through the opening of the coupling frame, a receptacle of the power supply input socket being exposed outside the housing, the coupling frame being sandwiched by the housing and the receptacle of the power supply input socket; and a power cord latch clip, the power cord latch clip being inserted into the two anchor bores, a power cord being grippable by the power cord latch clip when the power cord is plugged into the power supply input socket.

2. The coupling device of claim 1, wherein the coupling frame is attached to a circumference of the socket opening of the housing, and wherein the opening of the coupling frame and the socket opening of the housing are aligned.

3. The coupling device of claim 2, wherein the opening of the coupling frame and the socket opening of the housing have a substantially same shape.

4. The coupling device of claim 1, wherein the two anchor flanges are perpendicular to a plane on which the opening of the coupling frame sits.

5. The coupling device of claim 1, wherein the power cord latch clip further includes a holding portion for gripping the power cord.

6. The coupling device of claim 1, wherein the power cord latch clip is rotatable along an axis passing through the two anchor bores.

7. The coupling device of claim 3, wherein the two anchor flanges are perpendicular to a plane on which the opening of the coupling frame sits.

8. The coupling device of claim 7, wherein the power cord latch clip further includes a holding portion for gripping the power cord.

9. The coupling device of claim 8, wherein the power cord latch clip is rotatable along an axis passing through the two anchor bores.

* * * * *